United States Patent [19]

Batts et al.

[11] 4,101,059

[45] Jul. 18, 1978

[54] TALLY

[75] Inventors: John H. Batts; Judd F. Garrison, both of Grand Rapids; Douglas F. Wolff, Marshall, all of Mich.

[73] Assignee: John Thomas Batts, Inc., Zeeland, Mich.

[21] Appl. No.: 800,337

[22] Filed: May 25, 1977

[51] Int. Cl.[2] ..... A47J 51/098

[52] U.S. Cl. ..... 223/85; 40/2 R; 40/18; 40/322

[58] Field of Search ..... 223/85, 88, 92, 93, 223/94; 40/322, 2 R, 17, 18

[56] References Cited

U.S. PATENT DOCUMENTS

| | | | |
|---|---|---|---|
| 2,801,036 | 7/1957 | Klein | 223/92 |
| 2,967,366 | 1/1961 | Colbert | 40/17 X |
| 3,991,499 | 11/1976 | Kazumaru | 40/17 X |

FOREIGN PATENT DOCUMENTS

| | | | |
|---|---|---|---|
| 937,188 | 9/1963 | United Kingdom | 40/17 |

*Primary Examiner*—George H. Krizmanich

*Attorney, Agent, or Firm*—Price, Heneveld, Huizenga & Cooper

[57] ABSTRACT

A tally having suitable information imprinted thereon is formed from flexible, sheet material and defines a locking detent notch opening through a transverse edge thereof. Extending outwardly from the transverse edge opposite the locking detent notch is an indexing or stop tab. A hanger includes a tally attaching means having a recess defined by opposed walls or flanges having grooves formed therein. One of the grooves includes an inwardly directed detent adapted to snap fit into the notch of the tally. The other groove is of stepped configuration in cross section and includes a stop against which the tab abuts when the tally is inserted between the grooves.

20 Claims, 9 Drawing Figures

TALLY

BACKGROUND OF THE INVENTION

This invention relates to display devices, and more particularly to a garment hanger tally system.

In the display and sale of various articles, primarily clothing, the need exists for presenting price, style, or size information, for example, to a perspective customer or to sales personnel. Such information should be readily viewable when the garments and the like are suspended from hangers which, in turn, are disposed on suitable display racks. Such information display systems are commonly referred to as tally systems. It is highly desirable that these systems have provision for ready interchangeability of the tallies with the hangers and that the tallies themselves be readily and easily attached to the hangers.

Heretofore, various proposals have been made for providing a garment hanger with a tally holder or attaching device. For example, U.S. Pat. No. 1,348,952, to Landry, entitled CARD HOLDER FOR GARMENT HANGERS and issued Aug. 10, 1920, discloses a garment hanger including a portion adapted for receipt of a ticket-like or card-like tally imprinted with suitable pricing, styling, or similar information. The system disclosed in this patent includes the hanger body being formed with an upwardly opening recess defined by three grooved sides and one side opening through a surface of the hanger. The grooved recess is adapted for receipt of a generally rectangular tally. A tally holder of this type requires that one of the walls defining the recess be opened for sliding receipt of the tally. If opposed sides of the recess were left open, the card or tally could be pushed straight through the holder. Further, no provision is made with this system for positively locking or retaining the tally within the garment holder. As a result, the tally may be inadvertently removed from the hanger when placed on a display rack.

SUMMARY OF THE INVENTION

In accordance with the present invention, a unique, improved tally system is provided wherein the tally and the tally attaching means are relatively simply and easily manufactured, and whereby a card or ticket-like tally is readily and easily attachable to the hanger without displacement from a preferred position. Essentially, the tally comprises a sheet material member defining a detent notch opening outwardly through one of its edges. At the edge opposite the detent notch, a stop tab is provided. The tally attaching device includes means defining a pair of opposed grooves which are spaced so that an edge of the tally may be slidably inserted within each of the respective grooves. A detent within one of the grooves extends toward the other groove. The other groove includes a stop against which an edge of the tally tab abuts when the tally is slidably inserted between the grooves. The detent snaps into the notch formed in the tally, thereby locking the tally in position and preventing inadvertent displacement of the tally from the hanger. The tally tab and the stop insure that the tally is not slipped through the grooves during installation.

In narrower aspects, the tally attaching means may be molded integral with a body portion of a hanger.

The tally system in accordance with the present invention permits ready display of pricing, sizing or style information, for example, which may be quickly and easily changed. As a result, the hangers incorporating the tally attaching system of the present invention may be employed to display a wide variety of garments. Further, the detent notch and stop features prevent tipping, cocking or other displacement of the tally from a preferred position during installation.

DETAILED DESCRIPTION OF THE PREFERRED EMBODIMENT

Figure 1:
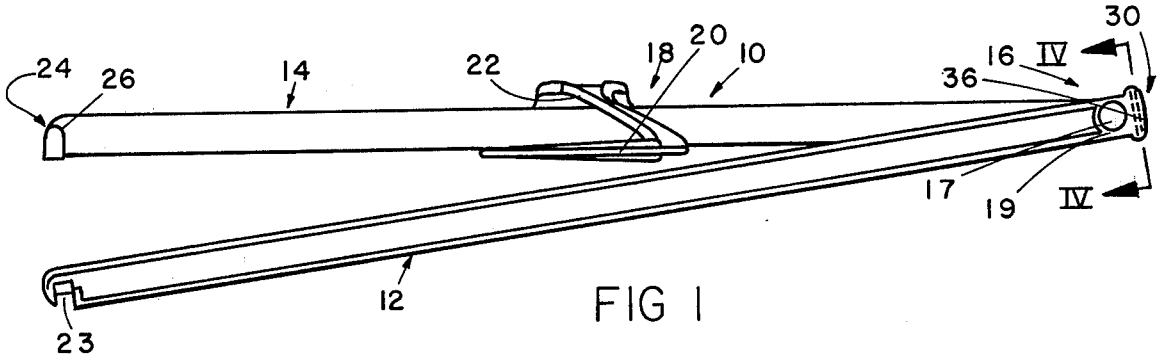
FIG. 1 is a top, plan view of a garment hanger incorporating the tally system in accordance with the present invention.
Figure 2:
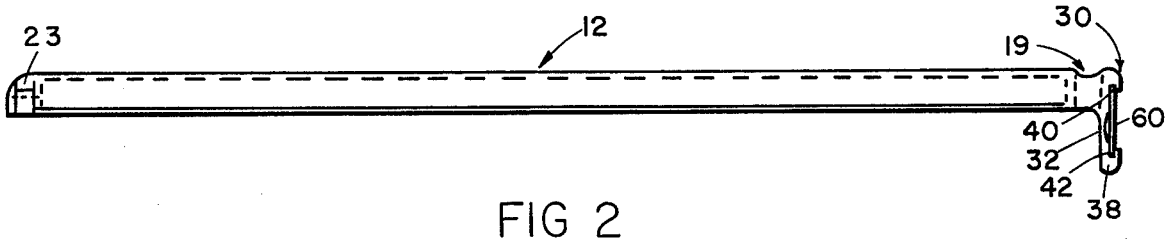
FIG. 2 is a front, elevational view of a portion of the garment hanger of FIG. 1.

With reference to the drawings, FIGS. 1 and 2 illustrate a pants hanger generally designated 10, which incorporates the unique tally system in accordance with the present invention. The pants hanger 10 includes an upper bar 12 and a spaced, lower bar 14. Adjacent ends of the bars are interconnected by a hinge means 16. The hinge means 16 includes a pivot post 17 on the lower bar 14 inserted into a socket 19 defined by the upper bar 12. A support hook 18 including a hook portion 20 and a stem 22 is joined to the center of the lower bar 14. The free end of the upper bar 12 is provided with a recess 23. The free end of the lower bar 14 is provided with a side latch member 24 having a leg 26 adapted to be inserted into the recess 23 when the upper bar is pivoted to a closed position above the lower bar. The pants hanger 10 is adapted to suspend a pair of pants, trousers, slacks or the like by looping or folding the trousers over the upper bar 12 and then latching or locking the free ends of the bars 12, 14. This hanger is shown for illustrative purposes only. A detailed description of the hanger 10 may be found in commonly owned, copending application, Ser. No. 773,536, entitled "LOCKING PARALLEL BAR HANGER", and filed Mar. 2, 1977 in the names of John H. Batts and Judd F. Garrison.

It should be understood that other hangers may incorporate the present invention. For example, the shirt or coat hanger 90 of FIGS. 8 and 9 may include the unique tally system described below. The body of the shirt hanger 90 includes a central neck 92, outstanding arms 94 and a support hook 96. The stem 98 of the hook 96 is joined integral with the neck 92 by a triangular portion 100.

Figure 7:
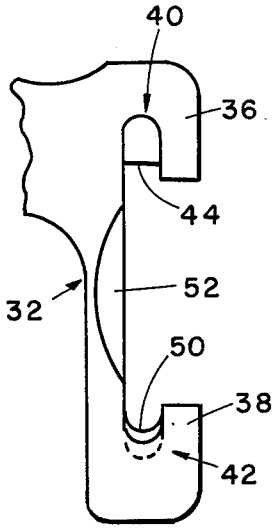
FIG. 7 is an enlarged, fragmentary, side elevational view of the tally attaching means.
Figure 8:
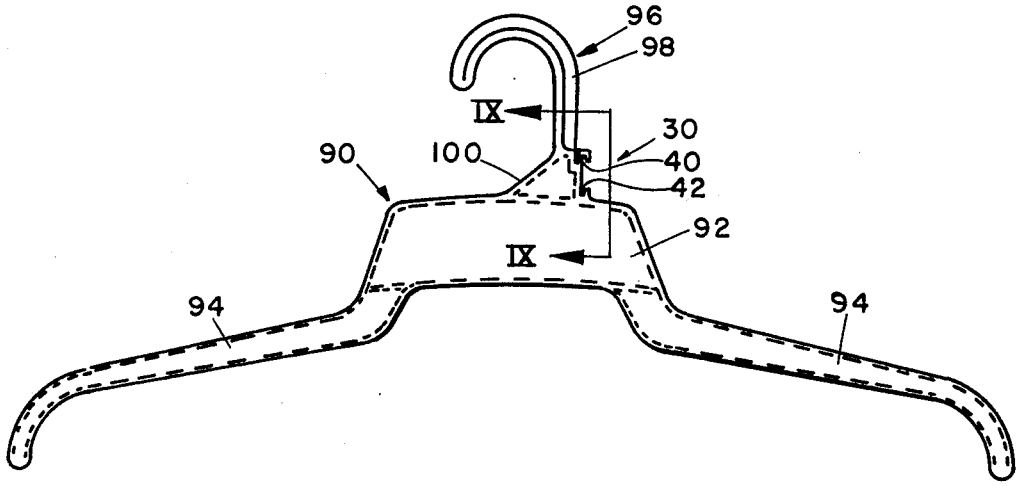
FIG. 8 is a front, elevational view of another garment hanger including the tally system in accordance with the present invention.
Figure 9:
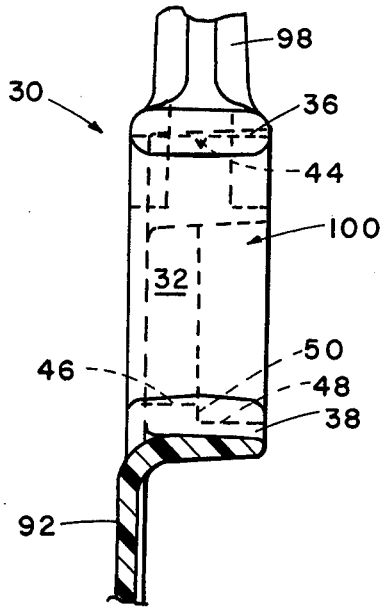
FIG. 9 is an end, elevational view taken generally along line IX—IX of FIG. 8.

The unique tally attaching means, generally designated 30, in accordance with the present invention, is shown integral with the hanger 10 adjacent the hinge means 16 at the end of and integral with the upper bar 12 and with the hanger 90 along a lateral edge of portion 100. The hanger 10 includes an end flange 32 at the end of the upper bar 12 (FIGS. 1 and 2). The flange 34 includes an extension 36 which extends outwardly beyond the end flange 32. Spaced from and opposing the flange extension 36 is another flange 38 which extends outwardly adjacent the lower transverse edge of the end wall 32. The flanges 36, 38, as best seen in FIG. 7, define opposed, inwardly opening guide tracks or grooves 40, 42 respectively. The end wall 32 of the hanger and the flanges or opposed walls 36, 38 therefore define a recess including the guide tracks or grooves 40, 42 extending through and opening outwardly at the lateral edges of the recess. Hanger 90 includes similar flanges 36, 38 defining opposed grooves 40, 42 (FIGS. 8 and 9). Also, portion 100 includes an end or lateral edge flange 32.

Figure 4:
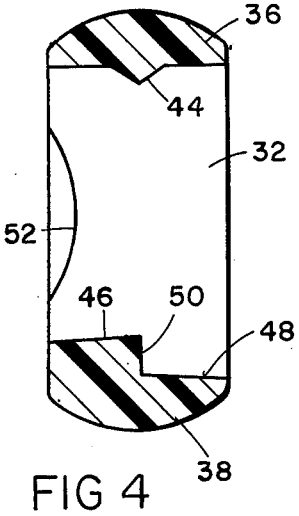
FIG. 4 is an enlarged, cross-sectional view taken generally along line IV—IV of FIG. 1.

As best seen in FIGS. 4, 7 and 9, the flange 36 of the hanger body also defines an inwardly directed locking detent member 44. The detent member 44 is generally V-shaped in vertical cross section and the apex thereabove is directed towards the opposite groove 42. It is preferred that the detent 44 be positioned centrally of the groove 40 and be dimensioned so as to be wholly confined within the groove 40.

The opposite groove 42, which in the preferred construction opens toward groove 40 in the same plane, is generally stepped in vertical section and includes a side wall 46, a side wall 48 and an intermediate, vertical stop 50. In the preferred construction, the plane of the face of stop 50 intersects the apex of the detent 44 (FIG. 4). The end wall 32 may be formed with a curved notch 52 opening outwardly through a lateral edge thereof (FIGS. 4 and 7). The notch 52, as will be more fully explained below, increases the ease with which a card-like or ticket-like tally may be removed from the tally attaching device.

Figure 5:
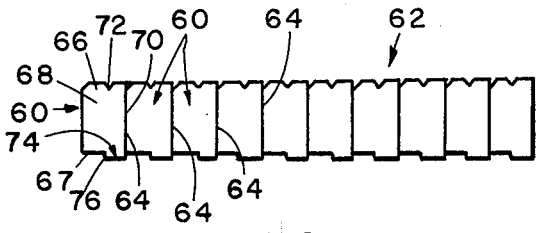
FIG. 5 is a plan view of a plurality of ticketlike tallies in accordance with the present invention.

A tally, in accordance with the invention and generally designated 60, is slidably disposed within the guide tracks or grooves 40, 42 (FIG. 2). As seen in FIG. 5, a plurality of tallies 60 may be formed from a single sheet of flexible, semi-rigid plastic or other such suitable material through a simple stamping or cutting die type operation to form a blank 62. Each of the individual tallies 60 may be separated from the bank along score lines 64 defined during the stamping operation.

Figure 6:
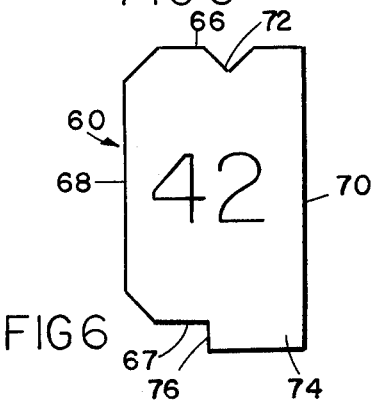
FIG. 6 is an enlarged, plan view of a single tally.

Each tally 60, as best seen in FIG. 6, is of a generally rectangular shape including opposed transverse edges 66, 67 and opposed lateral edges 68, 70.The tally has a thickness corresponding to the width of the grooves so as to be slidable therebetween. Opening through the transverse edge 66 is a generally V-shaped notch 72. The notch serves as a locking detent notch which, as more fully described below cooperates with the locking detent 40 of the tally attaching means. The transverse edge 67 which is directly opposite the transverse edge 66 has a generally stepped configuration conforming generally to the shape of the groove 42 of the tally attaching device. As a result of this stepping of the transverse edge 67, the tally defines an outwardly extending stop tab 74. The tab 74 has a transverse dimension equal to the transverse dimension of side wall 48 of groove 42. The stop tab includes a lateral edge 76 which is adapted to abut the stop surface 50 of groove 42. The opposite lateral edge of the tab 74 is an extension of or is common with the lateral edge 70 of the overall tally 60. The edge 76 and the apex of notch 72 lie on the longitudinal center line of the tally 60. The end of the upper transverse edge 66 is beveled where it joins the lateral edge 68. Similarly, the end of the other transverse edge 67 is beveled where it joins the lateral edge 68. This bevelling increases the ease by which the tally may be inserted within the tally attaching means of the hanger.

Figure 3:
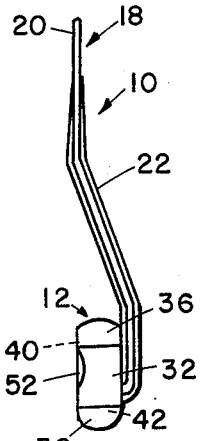
FIG. 3 is an end, elevational view of the garment hanger of FIG. 1 showing the tally attaching means.

As should now be readily apparent, the tally 60 is secured to the hanger by inserting or sliding the lateral edge 68 into the recess from the right side, as viewed in FIG. 3 and 9. The tally is slipped in until the locking detent 44 snaps into the similarly configured detent notch 72. At this point, the lateral edge 76 of the stop tab 74 will abut the stop surface 50 of the lower groove 42. As a result, the tally will be effectively locked or latched within the recess defined by the flanges 36, 38. The tally will not be inadvertently removed by brushing against adjacent hangers or articles or by a person brushing against the end of the hanger. The stop and the detent prevent sliding of the tally all the way through the grooves. In order to remove the tally, one need only place a finger behind the tally at the recess 52 and pull the tally outwardly until the detent slips out of the notch or until the tally snaps out of the grooves.

Of course, the tally system in accordance with the present invention may be employed on any hanger or garment display device which includes a surface viewable when the device is supporting a garment or the like. It is preferred that the members 36, 38 which define the recess and opposed grooves be molded integral with the hanger. The members 36, 38 may be formed as horizontal members or as vertical members depending on the particular application. If necessary, however, the tally attaching device could be molded as a separate unit, and subsequently attached to the garment display device. In view of the foregoing description, these and various other modifications will undoubtedly become apparent to one of ordinary skill in the art. Therefore, it is expressly intended that the above description should be considered as that of the preferred embodiment. The true spirit and scope of the present invention will be determined by reference to the appended claims.

The embodiments of an invention in which an exclusive property or privilege is claimed are defined as follows:

1. A device for displaying information on a garment hanger, comprising:

a flexible sheet member tally, said sheet member tally defining a locking detent notch intermediate the lateral edges thereof along a transverse edge, said sheet member tally also including a stop tab extending outwardly from the other transverse edge; and a tally attaching means disposed on said hanger in plain view when a garment is suspended from said hanger for attaching said tally to said hanger, said attaching means including:

a first means defining a first groove and including a detent extending into said groove intermediate the ends thereof; and a second means defining a second groove, said second groove positioned spaced from said first groove and including a stop, said tally being insertable into said grooves and dimensioned so that when said tab abuts said stop said detent is disposed within said notch.

2. A device as defined in claim 1 wherein said notch is generally V-shaped, the mouth of said notch opening through said edge.

3. A device as defined in claim 2 wherein said detent is generally V-shaped in cross section, the apex of said detent extending towards said second groove.

4. A device as defined by claim 1 wherein said first and second grooves are opposed and open towards each other in the same plane.

5. A device as defined in claim 3 wherein said first and second grooves are opposed and open towards each other in the same plane.

6. A device as defined by claim 1 wherein said first means comprises:

a flange extending generally perpendicular outwardly from a surface of said hanger a distance at least sufficient to define said groove.

7. A device as defined by claim 6 wherein said second means comprises:

another flange extending generally perpendicular outwardly from said surface of said hanger, said another flange being spaced from and extending parallel to said flange.

8. A device as defined by claim 5 wherein said first means comprises:

a flange extending generally perpendicular outwardly from a surface of said hanger a distance at least sufficient to define said groove.

9. A device as defined by claim 8 wherein said second means comprises:

another flange extending generally perpendicular outwardly from said surface of said hanger, said another flange being spaced from and extending parallel to said flange.

10. A tally comprising:

a flexible sheet member having transverse and lateral edges, said sheet member defining a locking detent notch opening through one of said edges, the edge opposite said notched edge being stepped and thereby defining a stop tab.

11. A tally as defined by claim 10 wherein said notch and said stop tab are at the transverse edges of said tally and the lengths of said lateral edges are greater than the lengths of said transverse edges.

12. A tally as defined by claim 11 wherein said notch is V-shaped and said stop is rectangular and includes an edge partially in common with one of said lateral edges.

13. A tally as defined by claim 12 wherein the ends of the lateral edge opposite said tab are beveled.

14. A tally as defined by claim 13 wherein the lateral edge of said tab opposite said common edge and the apex of said notch lie on the longitudinal center line of said tally.

15. A garment hanger adapted for receipt of a tally, the tally being generally rectangular in shape formed from sheet material and having a detent notch opening through one edge, said hanger comprising:

a body member having a generally flat surface readily viewable when a garment is suspended from said hanger; said body member defining a recess open along at least one side and including opposed, closed sides, the portion of said body member along said opposed closed sides defining a pair of opposed, inwardly facing grooves, the spacing between said grooves being such that said one edge and said second edge are slidable therein, one of said grooves having disposed therein a detent dimensioned to snap into said detent notch.

16. A garment hanger as defined by claim 15 wherein the tally further includes a tab extending outwardly from a second edge opposite said one edge and wherein the other of said grooves is stepped in vertical section to thereby define a stop against which said tab abuts when said tally is inserted between said grooves.

17. A garment hanger as defined by claim 16 wherein said detent is V-shaped in cross section, the apex of said detent extending toward said other groove.

18. A garment hanger as defined by claim 17 wherein said grooves are in the same plane.

19. In combination, a garment hanger and a detachable tally, said garment hanger having a tally receiving channel-like track defined by a pair of spaced, parallel grooves, a locking detent in one of said grooves and an offset stop shoulder in the other of said grooves, said stop shoulder and detent extending toward each other; a tally of semi-rigid, resilient sheet material of a thickness to be slidably received in said grooves, said tally having an offset stop in one edge seated against said stop shoulder and a notch in an edge thereof for receiving said detent.

20. In combination, a garment hanger and a detachable tally, said garment hanger having a tally receiving channel-like track defined by a pair of spaced parallel grooves, a locking detent in one of said grooves; a tally of semi-rigid, resilient sheet material of a thickness to be slidably received in said grooves, said tally having a notch in the opposite edge for receiving said detent.

* * * * *